United States Patent [19]

Veltri et al.

[11] Patent Number: 4,626,407

[45] Date of Patent: Dec. 2, 1986

[54] METHOD OF MAKING AMORPHOUS BORON CARBON ALLOY CUTTING TOOL BITS

[75] Inventors: Richard D. Veltri, East Hartford; Francis S. Galasso, Manchester, both of Conn.

[73] Assignee: United Technologies Corporation, Hartford, Conn.

[21] Appl. No.: 227,315

[22] Filed: Jan. 22, 1981

Related U.S. Application Data

[62] Division of Ser. No. 12,930, Feb. 16, 1979.

[51] Int. Cl.[4] ..... C22C 32/00; B22F 7/06

[52] U.S. Cl. ..... 419/18; 76/101 R; 75/238; 407/119

[58] Field of Search ..... 407/119; 76/101 R, 101 A, 76/108 R; 75/238; 419/18, 48, 60

[56] References Cited

U.S. PATENT DOCUMENTS 2,356,009 8/1944 Schwarzkopf ..... 407/119 X 4,225,355 9/1980 Galasso et al. ..... 106/43

FOREIGN PATENT DOCUMENTS 379681 8/1932 United Kingdom ..... 75/238

*Primary Examiner*—Roscoe V. Parker

*Attorney, Agent, or Firm*—Harry J. Gwinnell

[57] ABSTRACT

Amorphous boron-carbon alloy cutting tool bits and methods of making them are described. The tool bits can be composites of conventional hard alloys containing the amorphous boron carbon alloy in a first layer over a conventional hard alloy layer such as cobalt bonded tungsten carbide. The amorphous boron carbon alloy used is preferably produced in bulk with a grain size less than 30 Å and ground into a powder. The tool bits are produced by cold compressing, in a tool bit die, the lower layer material at about 2000 psi followed by hot compressing the composite containing the added amorphous boron carbon alloy powder at about 1350°-1500° C. The resultant cutting tool bit has a cutting lifetime at least four times that of conventional carbide cutting tool bits even when cutting such things as nickel superalloys at speeds in excess of 125 surface feet per minute (SFM).

9 Claims, 2 Drawing Figures

FIG. 1
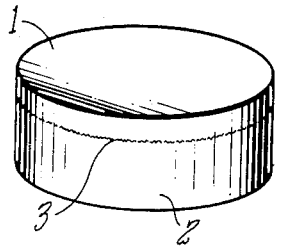
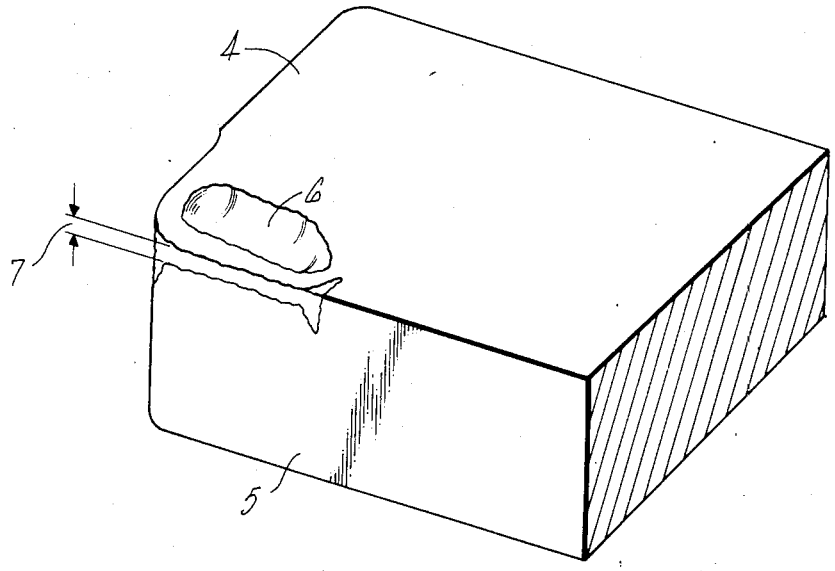
FIG. 2

METHOD OF MAKING AMORPHOUS BORON CARBON ALLOY CUTTING TOOL BITS

CROSS-REFERENCE TO RELATED APPLICATIONS

This is a division of application Ser. No. 12,930 filed on Feb. 16, 1979.

Application Ser. No. 12,930, filed Feb. 16, 1979, assigned to the same assignee and of even filing date herewith, describes a method of making amorphous boron-carbon alloys in bulk form; and co-pending application Ser No. 859,883 filed Dec. 12, 1977 now abandoned, by the same applicants and assigned to the same assignee describes cobalt-bonded tungsten carbide tools.

BACKGROUND OF THE INVENTION

1. Field of the Invention

The field of art to which this invention pertains is cutters for shaping comprising tools of specific chemical compositions, and methods of making the same.

2. Description of the Prior Art

With the development in the metallurgical area of newer and harder alloys and superalloys such as the nickel based superalloys the use of conventional cutting tools has become less acceptable. Not only do conventional cutting tools wear faster when cutting the newer alloys but they must be used at cutting speeds much slower than desired because of their lack of durability on such hard alloys. Accordingly, inventive attention has turned to producing more durable cutting tools which can be used at high cutting speeds. And while great strides have been made in this area, note for example, co-pending U.S. application Ser No. 859,883, the search for even better tools continues.

BRIEF SUMMAPY OF THE INVENTION

According to the present invention, an amorphous boron-carbon alloy cutting tool bit and method of making the same have been invented. The cutting tool bit can be a composite made of amorphous boron-carbon powder and conventional tool material powder such as tungsten carbide with a binder material such as cobalt. The tool bit with amorphous boron-carbon alloy present at least at the cutting surface has greater than four times the lifetime of conventional tungsten carbide cutting tool bits when used at greater than 125 surface feet per minute (SFM) to cut such things as nickel based superalloys. The amorphous boron-carbon alloy used is preferably produced in bulk with a grain size of less than 30 Å and is ground into a powder.

The cutting tool is preferably made by compressing the amorphous boron-carbon alloy containing composition at high temperatures and pressures in a tool bit die. The amorphous boron-carbon alloy can be compressed (a) alone with a binder, (b) in admixture with other hard alloys or (c) compressed sequentially with other alloys, e.g., in a two-stage compression where a conventional alloy powder such as cobalt-tungsten carbide mixture is first cold compressed, followed by the addition of amorphous boron-carbon alloy and binder, or an admixture of the alloy with other alloys, to the die and a hot compression of the entire die contents.

The foregoing and other objects, features and advantages of the present invention will become more apparent from the following description of preferred embodiments and accompanying drawings.

DESCRIPTION OF THE DRAWINGS

FIG. 1 demonstrates schematically tool bits made according to the present invention.

FIG. 2 is a perspective view of a tool bit illustrating wear land.

DETAILED DESCRIPTION OF PREFERRED EMBODIMENTS

The preferred method of the present invention comprises filling a die with conventional tool bit material such as tungsten carbide-cobalt and compacting the powdered alloy without heat. The die is next filled with an alloy containing amorphous boron-carbon and the composite is compressed at high pressures and temperatures to form the composite tool bit. The resultant article has approximately four times the lifetime of conventional tool bits even at cutting speeds in excess of 125 sfm.

The die used can be any conventional cutting tool bit die such as, for example, a cylindrical graphite die. And while the entire cutting tool bit can be made from amorphous boron-carbon alloy with a binder such as cobalt, it is more economically expedient to combine a minor portion of boron-carbon alloy with a major portion of conventional cutting material, such as a cobalt and tungsten carbide powder mixture.

In the preferred method of the present invention the graphite die is first filled with a conventional cutting alloy powder such as a cobalt-tungsten carbide mixture. This mixture generally represents 75 to 95% by weight of the final total tool bit alloy content, and preferably about 84%. This mixture is cold pressed at pressures of 1500 to 2500 psi, preferably 2000 psi for anywhere from 1 to 10 minutes, and preferably 3 minutes, until a compact is formed. The amorphous boron-carbon alloy powder is then added to the die either in admixture with a fugitive binder such as $ZrH_2$ or with a conventional cutting tool alloy such as a cobalt-tungsten carbide powder mixture which also acts as a matrix or binder. Combinations of the two can also be used. Note the Table. The fugitive binder such as $ZrH_2$ can be added in amounts up to 2% by weight of the alloy powder added at this time, with about 0.6% being preferred. If the carbide alloy mixture is used, the amorphous boron-carbon should be present in amounts of about 2 to 16% by weight of the powder added at this time, with about 8% being preferred. And the amount of cobalt in the cobalt-tungsten carbide used both in the former and latter die additions is also about 2 to 16% by weight, with 5% preferred. The die is then again compacted at 1500 to 2500 psi, preferably 2000 psi, and heated, e.g., by placement in a suitable furnace assembly, to 1350° to 1500° C., preferably 1400° C., for 2 to 10 minutes, preferably 8 minutes. The heating can be done under vacuum of less than 5 torr, although such vacuum is not required. The tool is then allowed to cool under the same pressure conditions being maintained during the heating cycle. Such cooling usually takes from 15 to 30 minutes. Such cooling can be performed under an inert atmosphere such as argon, although such is not required. After cooling, the tool bit can be polished by conventional diamond paste to produce the finished product.

Typically the cutting tools produced are in the form of tool bit discs 0.5 inch in diameter and 0.2 inch thick. Such tool bits show wear land of less than 0.020 inch after 4 minutes of cutting IN100 nickel superalloy (12.4% Cr, 18.5% Co, 0.07% C, 4.3% Ti, 5.0% Al, 3.2% Mo, 0.8% V, balance nickel, all % by weight) at 150 sfm. As used herein wear land is defined as wear parallel to the cutting edge along the clearance face of the tool. Note FIG. 2. Wear land in excess of an established limit indicates that the cutting edge has become too blunt and misshapen to cut in a precise and efficient manner.

It will be understood by those skilled in this art that while this invention is described in terms of tool bits, this is meant to encompass the entire cutting tool as well. The essential part of the invention is the presence of the amorphous boron-carbon alloy at the cutting surface. This is not meant to exclude amorphous boron-carbon alloy throughout the rest of the tool, although this might not be economically expedient.

The amorphous boron-carbon alloy is present at the cutting edge of the cutting tool bit in any amount above about 2% by weight, preferably 3 to 10% by weight and most preferably 8% by weight, and is preferably made by grinding an amorphous boron-carbon alloy with a grain size preferably below 30 Å and most preferably below 15 Å. A While any process which can produce amorphous boron-carbon alloys with these grain sizes can be used, it is preferred to form boron-carbon alloy in bulk form such as described in copending application Ser. No. 12,930. To produce the amorphous boron-carbon alloy in bulk a reaction surface of the desired shape is subjected to a mixture of a carbon containing gas, a boron containing gas, and a reducing gas, at elevated temperatures to produce amorphous boron-carbon alloy in bulk form without crystallization. By amorphous is meant an extremely fine grained material, i.e., the absence of detectable grain boundaries when viewed with an electron microscope and extremely broad peaks in its x-ray pattern obtained with x-ray diffraction apparatus.

The carbon containing gas can be a $C_1$ to $C_5$ containing hydrocarbon or halogenated derivative thereof, with $CH_aX_b$ wherein $a+b=4$ and X is Cl, Br, F, I, or combinations thereof, being preferred and $CH_4$ being most preferred. The boron source can be diborane or preferably $BX_3$ with X defined as above and $BCl_3$ being most preferred. And hydrogen is the preferred reducing gas used.

By controlling the Reynolds number flow condition of the deposition, which also depends to some degree on the temperature of deposition and ratios of reactants, the bulk samples (greater than 10 and preferably greater than 40 mils) are produced. Bulk deposition conditions are also evidenced by such things as the absence of grain boundaries in the boron-carbon alloy produced and the lack of sharp x-ray diffraction patterns in the boron-carbon samples produced.

The Reynolds number is a ratio defined in terms of the velocity of reactive gas flow, the diameter of the reaction vessel, the viscosity of the gaseous reactants and their density. Numerically this ratio is defined by the following formula:

$$Re=Dv\rho/\mu$$

where

D=diameter of the reaction chamber v=velocity of flow of the gas mixture in the reaction chamber $\rho$=density of the gas mixture $\mu$=viscosity of the gas mixture Reynolds numbers of 40–120 result in bulk deposition without crystallization, with Reynolds numbers of 60–100 giving the smallest detectable grain sizes. The grain sizes can be calculated from x-ray diffraction data according to well-known and accepted procedures. Note *Elements of X-Ray Diffraction,* B. D. Cullity (Addison-Wesley Pub. Co., 1956).

The temperature of reaction of the gases is preferably 950° C. to 1300° C. At temperatures below 950° C. excess carbon is produced tending to result in a sooty reaction product. And above 1300° C. reaction takes place too rapidly tending to result in crystalline boron formation intertwined with the carbon. While temperature ranges between 950°–1300° C. give useful amorphous boron-carbon alloys, optimum results are obtained between 1120° and 1170° C. Generally, useful articles above 40 mils in thickness can be obtained over these temperature ranges in one to two hours.

The ratio of reactants may vary somewhat. However, to obtain the preferred minimal grain size, the molar ratios of carbon containing gas to boron containing gas is 0.5/1.0 to 6.0/1.0, carbon containing gas to boron+-carbon containing gases 0.3/1 to 0.9/1, and carbon containing gas to total gaseous reactants (C, B and reducing gases) 0.15/1 to 0.5/1.

The cobalt-bonded tungsten carbide alloy useful in the present invention is that, for example, described in applicants' co-pending patent application Serial No. 859,883, filed Dec. 12, 1977, the disclosure of which is incorporated by reference. As described therein the tungsten carbide powder contains 4 to 10% by weight cobalt. A commercially available tungsten carbide-cobalt powder mixture useful in the present invention is that sold by Kenametal, Inc. and contains 5% by weight cobalt, is 325 mesh and paraffin free.

EXAMPLE 1

A graphite tool bit die having an internal diameter of 0.5 inch and a depth of 0.2 inch is filled with 8.8 grams of tungsten carbide-5% cobalt (by weight) powder and compacted cold at about 2000 psi. A mixture of 0.06 gram of boron-carbon amorphous alloy (formed by the bulk processing described above) and 0.75 gram of tungsten carbide-5% cobalt is then added to the die and the entire die contents are pressed at 2000 psi at temperatures between 1350°–1500° C. for approximately 8 minutes. The finished tool bit was used to cut nickel superalloy such as those described in commonly assigned U.S. Pat. No. 3,843,421 for over four minutes at 150 sfm. This is four times the lifetime of conventional tooling when it is used at these speeds and also superior to cobalt bonded tungsten carbide tooling such as described in U.S. patent application Ser. No. 859,883. That is why, for example, as mentioned in the "Description of the Prior Art," such conventional tooling is run at much slower speeds when cutting such alloys.

EXAMPLES 2–4

Utilizing the process conditions described in Example 1, three additional runs were made. The same base tungsten carbide-cobalt composition was used as described in Example 1. The boron-carbon component was used in an amount of 0.09 gram in admixture with 1.6 grams of tungsten carbide 5% cobalt in runs 2 and 3 and 1.45 grams of tungsten carbide-10% cobalt in run 4. In addition, in runs 2–4, 0.01 gram of $ZrH_2$ was used as a fugitive binder. The results for all three examples were similar to that of Example 1 with at least four times the durability of conventional tool bits presently in use. The compositions are summarized in the Table.

TABLE

| | Second Layer | First Layer |
|---|---|---|
| #2- | 8.80 lg (WC-5% Co) | .090 g B/C 1.60 g (WC-5% Co) .010 g $ZrH_2$ |
| #3- | 8.80 lg (WC-5% Co) | .090 g B/C 1.60 g (WC-5% Co) .010 g $ZrH_2$ |
| #4- | 8.80 lg (WC-5% Co) | .090 g B/C 1.45 g (WC-10% Co) .010 g $ZrH_2$ |

FIG. 1 depicts a typical tool bit according to the present invention. In the figure, 1 indicates the boron-carbon amorphous alloy containing first layer of the tool bit and 2 the tungsten carbide-cobalt second layer portion of the tool bit with 3 indicating the interface of the two. In actuality this interface will be only difficultly discernable, if at all.

FIG. 2 shows the wear land in a tool bit. In the figure, 4 indicates the rake face of the bit, 5 the clearance face, 6 a crater and 7 the wear land. As stated above the wear land of tool bits according to the present invention is less than 0.020 inch, much superior to conventional tool bit material.

Although this invention has been shown and described with respect to a preferred embodiment thereof, it should be understood by those skilled in the art that various changes and omissions in the form and detail thereof may be made therein without departing from the spirit and scope of the invention.

Having thus described a typical embodiment of our invention, that which we claim as new and desire to secure by Letters Patent of the United States is:

1. A process of forming an amorphous boron-carbon alloy containing cutting tool bit comprising filling a tool bit die with an amorphous boron-carbon alloy and binder and subjecting the mixture to heat and pressure sufficient to form the cutting tool bit.

2. A process of forming an amorphous boron-carbon alloy cutting tool bit comprising filling a cutting tool bit die with a mixture of cobalt and tungsten carbide powder, compacting said powder at at least 1000 psi without heating, filling the die with a mixture of cobalt and tungsten carbide and at least 5% by weight amorphous boron-carbon alloy, and compressing the total die contents at at least 1000 psi at 1350° to 1500° C. to form said tool bit.

3. A process of forming an amorphous boron-carbon alloy tool bit comprising filling a graphite die 0.2 inch deep and 0.5 inch internal diameter with a mixture of tungsten carbide and 5 to 10% cobalt by weight, compacting the mixture without heating at 2000 psi, filling the die with a mixture of tungsten carbide, 5 to 10% cobalt by weight and 2 to 16% amorphous boron-carbon alloy, compressing the entire die contents at 1350° to 1500° C. and 2000 psi to form said tool bit, removing the tool bit from the die, and polishing the tool bit with diamond paste.

4. The process of claims 1, 2 or 3 wherein the process is carried out at such pressure, temperature and time so as to produce a tool of such hardness as to be capable of cutting IN100 nickel superalloy at 150 surface feet per minute for over 4 minutes.

5. The process of claims 1, 2 or 3 wherein the amorphous boron-carbon alloy powder additionally contains $ZrH_2$.

6. The process of claim 1 wherein the process is a multi-step process and the first step comprises a cold compression of a mixture of cobalt, and tungsten carbide prior to filling the die with the amorphous boron-carbon alloy.

7. The process of claims 2 or 6 wherein the cobalt in the first step comprises 5 to 10% by weight of the tungsten carbide containing mixture.

8. The process of claim 3, wherein the amorphous boron-carbon alloy additional contains cobalt, and tungsten carbide.

9. The process of claims 1 or 2 wherein the amorphous boron-carbon is present in the powder mixture in amounts of 2 to 16% by weight.

* * * * *